United States Patent [19]

Nagasawa et al.

[11] Patent Number: 4,614,045

[45] Date of Patent: Sep. 30, 1986

[54] METHOD AND APPARATUS FOR CIRCULATING HOT AIR IN BOARD DRYING APPARATUS

[75] Inventors: Kiyoshi Nagasawa, Chita; Mitsuhiro Kuroyanagi, Okazaki; Tadashi Aizawa, Nagoya, all of Japan

[73] Assignee: Hashimoto Denki Co., Ltd., Aichi, Japan

[21] Appl. No.: 724,683

[22] Filed: Apr. 18, 1985

[30] Foreign Application Priority Data

Apr. 27, 1984 [JP] Japan ..... 59-87223

[51] Int. Cl.[4] ..... F26B 3/04; F26B 21/12

[52] U.S. Cl. ..... 34/34; 34/54; 34/149

[58] Field of Search ..... 34/54, 107, 149, 219, 34/227, 236, 23, 34; 198/607, 611, 782, 424; 271/189, 192

[56] References Cited

U.S. PATENT DOCUMENTS

| | | | |
|---|---|---|---|
| 353,816 | 12/1886 | Richards | 34/149 |
| 1,564,491 | 12/1925 | Rees | 34/219 |
| 3,074,180 | 1/1963 | Ahlstedt | 34/213 |
| 3,320,677 | 5/1967 | Reitzel | 34/54 |
| 3,520,396 | 7/1970 | Lingg | 198/77 |
| 3,848,725 | 11/1974 | Toby | 198/35 |
| 4,562,650 | 1/1986 | Nagasawa et al. | 34/149 |

FOREIGN PATENT DOCUMENTS

| | | | |
|---|---|---|---|
| 488062 | 12/1953 | Italy | 34/149 |
| 55489 | 7/1935 | Norway | 34/149 |

*Primary Examiner*—Albert J. Makay
*Assistant Examiner*—David W. Westphal
*Attorney, Agent, or Firm*—Wenderoth, Lind & Ponack

[57] ABSTRACT

Boards to be dried, such as veneer are placed, one after another, on a pair of fork conveyors disposed opposite to each other. The boards are kept in the form of layers separated and carried downwardly in this fashion, so that the boards can be dried by hot air blown and circulated in the horizontal direction through a space between the two conveyors during their downward voyage. The space between the two fork conveyors is divided into a central passage portion and right and left passage portions, and the flow amount of the hot air at the right and left passage portions is controlled to be somewhat less than the hot air at the central passage portion. In this way, possible dry cracking and wave-shaped shrinkage can be effectively prevented.

7 Claims, 5 Drawing Figures

METHOD AND APPARATUS FOR CIRCULATING HOT AIR IN BOARD DRYING APPARATUS

BACKGROUND OF THE INVENTION

This invention relates to a method and apparatus for circulating hot air through a board drying apparatus, and more particularly to a hot air circulating method and apparatus wherein boards to be dried, mainly such boards still containing a large amount of water such as, for example, veneer, calcium silicate board, pulp cement, plaster board and fiber board are stacked on a pair of gate-like fork conveyors disposed opposite to each other, and such boards to be dried are transferred from an upper portion thereof to a lower portion thereof in separated relationship, i.e., layers of many boards, and in the process of downward voyage of the boards, a hot air is blown and circulated in the space between the pair of fork conveyors in the horizontal direction for drying the boards.

A hot air circulating method and apparatus in a board drying apparatus of this type is known as disclosed in a U.S. patent application Ser. No. 587,703 filed Mar. 8, 1984. In the method of this earlier application, hot air is merely circulated in the horizontal direction along the elongated direction of the space between a pair of fork conveyors. Although this arrangement avoids drying irregularity among boards to be dried which are transferred one after another, almost no special consideration is rendered to a single board itself to be dried. Thus, every portion of the board is contemplated to be heated homogeneously.

However, especially, in the case the board to be dried is a veneer, when hot air is applied to it, due to minute vessels in the veneer, the moisture contained in a portion of the veneer near its periphery tends to be discharged outside in a comparatively short time through the vessels and thereby dried. On the contrary, the moisture contained in the central portion thereof is not easily discharged. Accordingly, the drying speeds are largely different between the central portion and the peripheral portion. Also, the moisture content of the dried veneer is always such as to be over-dried at the right and left marginal portions with respect to the longitudinal center portion thereof. As a result, dry cracking as well as wave shaped shrinkage often occur at the right and left marginal portions, thus often deteriorating the quality of the final product.

The present invention was accomplished in view of the above mentioned problems inherent to the prior art.

SUMMARY OF THE INVENTION

It is therefore an object of the present invention to provide a hot air circulating method and apparatus in a board drying apparatus wherein dry cracking as well as wave shaped shrinkage tending to occur at the marginal portions of boards to be dried are effectively prevented by adequately controlling the amount of hot air supplied to the central portion as well as to the right and left marginal portions thereof.

In order to achieve the above object, according to a hot air circulating method in a board drying apparatus of the present invention, boards to be dried such as veneer are placed, one after another, on a pair of fork conveyors disposed opposite to each other, and are carried downwardly from an upper portion to a lower portion thereof with the boards held spaced from each other, so that the boards can be dried by hot air blown and circulated in the horizontal direction through a space between the two conveyors during the downward movement, wherein the space between the two fork conveyors is divided into a central passage portion and right and left passage portions, and the flow amount of hot air at the right and left passage portions is controlled to be somewhat less than the flow amount of hot air at the central passage portion.

Also, an apparatus according to the invention comprises a pair of fork conveyors carrying boards to be dried such as veneer with spacings relative to each other in the vertical direction and disposed opposite to each other, the conveyors carrying the boards from an upper position to a downward position, heating means for producing hot air, an air blower adapted to blow and circulate hot air produced by the heating means through a space between the two fork conveyors in the horizontal direction, and rectifiers adapted to control the flow amount of the hot air and provided at the respective central portions and right and left portions of the inlet side and of the outlet side of a hot air circulating passage between the two fork conveyors.

BRIEF DESCRIPTION OF THE DRAWINGS

The nature of this invention, as well as other objects and advantages thereof, will be readily apparent from consideration of the following description relating to the accompanying drawings, in which like reference characters designate the same or similar parts throughout the figures thereof and wherein.

DETAILED DESCRIPTION OF THE INVENTION

Figure 1:
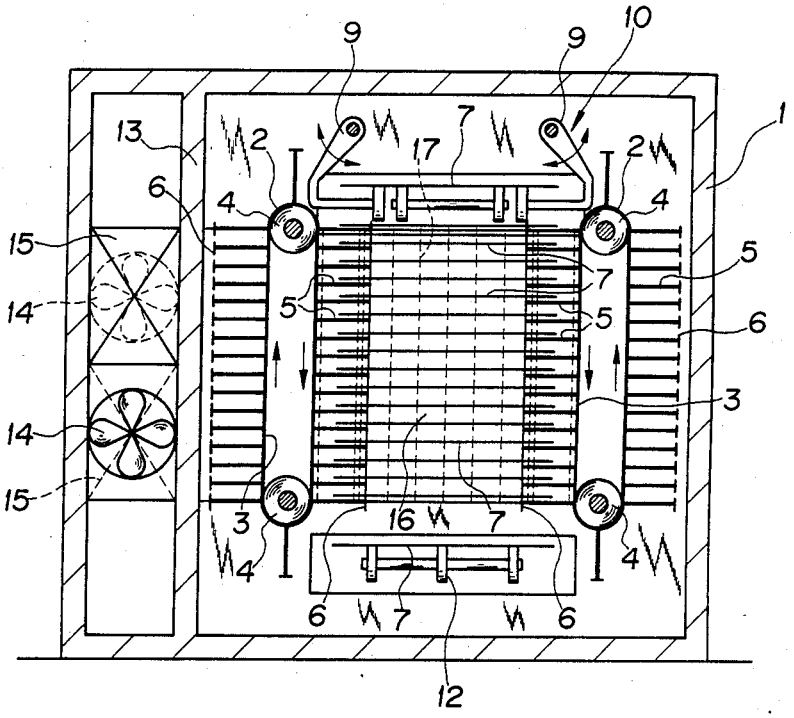
FIG. 1 is a front view showing a board drying apparatus according to the present invention.
Figure 2:
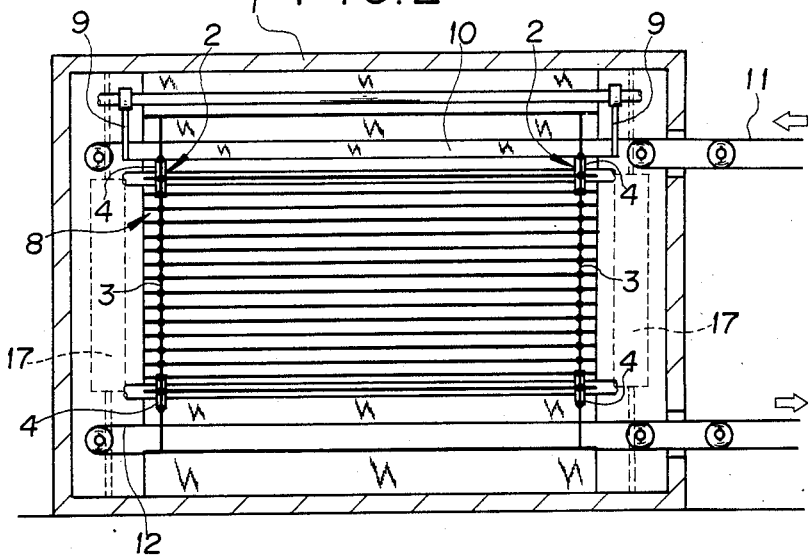
FIG. 2 is a side sectional view of the board drying apparatus of FIG. 1.

A preferred embodiment of the present invention shall be described hereunder with reference to the accompanying drawings.

A board drying apparatus according to a preferred embodiment of the present invention comprises a closed housing 1 in which a pair of fork conveyors 2 are disposed vertically with spacing therebetween. Each fork conveyor 2 has front and rear endless chains 3 in a double row which are entrained about upper and lower sprockets 4. The respective endless chains 3 of the respective fork conveyors 2 are fixed to end portions of a number of extension arms 5 which extend at right angles to the fork conveyors. Each pair of extension arms 5 corresponding to the front and rear endless chains of each conveyor 2 are connected at free end portions thereof with a strip-shaped plate 6 extending at right angles to arms 5. Each such pair of arms 5 and the respective strip-shaped plate 6 constitute a fork arm 8 for supporting boards 7 to be dried. The fork arms 8 provided on the pair of fork conveyors 2 are arranged in such positional relationship as to confront and be aligned with respect to each other, and the fork arm 8 positioned on the inner side of one of the fork conveyors 2 is moved downwardly at the same speed as that positioned on the inner side of the other fork conveyor 2. The length of the fork arms 8 for supporting opposite sides of a board to be dried is set at an appropriate value while taking into account the flexibility and strength of the board. It should be noted here that the distance between the front and rear endless chains in each fork conveyor is greater than the distance between the front endless chains or rear endless chains of the two fork conveyors 2, so that a large rectangular shaped board longer in the front-to-rear direction can be treated for drying.

Provided above and between the fork conveyors 2 is a delivery conveyor 10 having a pair of gate-like swinging arms 9. The swinging arms 9 are opposed to each other in the form of a gate and, when closed, support the board to be dried horizontally from both sides thereof. When the swinging arms 9 are opened, the board is dropped onto the uppermost horizontally positioned pair of fork arms 8.

In line with the delivery conveyor 10 is a feed conveyor 11 which extends beyond the housing 1 from one end portion of the delivery conveyor. The boards to be dried are intermittently fed from the feed conveyor 11 to the delivery conveyor 10. The swinging arms 9 of the delivery conveyor are opened in synchronism with the movement of the fork arms 8, so that the boards to be dried can be put on the fork arms 8 one after another.

Provided below and between the conveyors 2 is a discharge conveyor 12 which extends horizontally beyond the housing 1.

Accordingly, when the fork arms 8 on the inner sides of the fork conveyors 2 reach the lowermost positions and are rotated downwardly from their horizontal postures, the boards 7 on fork arms 8 are dropped onto the discharge conveyor 12, and are carried out of the housing 1.

Either one of the side walls of the housing 1 is formed with a partition wall 13. The housing 1 also includes fans 14 and heaters 15 disposed in series between the partition wall 13 and the side wall of the housing 1. The fans 14 and heaters 15 are arranged in pairs at respective upper and lower positions. It should be noted that the blowing directions of the hot air from the fans 14 at the upper and lower positions are opposite with respect to each other. The heaters 15 form a heating source and may comprise steam heated aerofine heaters.

Figure 3:
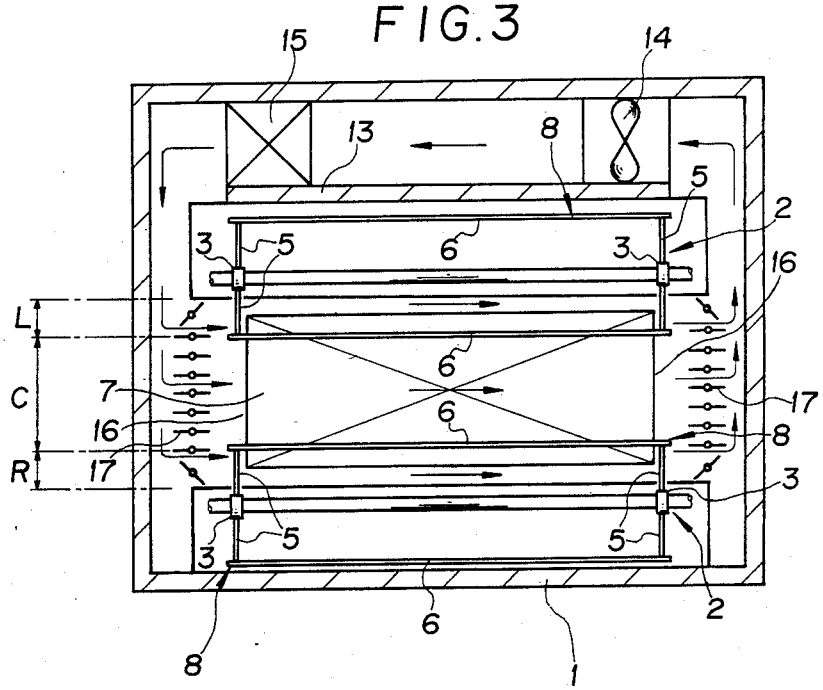
FIG. 3 is a plan sectional view of the board drying apparatus of FIG. 1.

When the fan 14 and heater 15 are operated, the air heated by the heater 15 is caused to circulate along a circulation passage which extends, as shown by arrows in FIG. 3, from the space between the partition wall 13 and the side wall to the fan 14 via the front or rear portion of the housing 1, then through a space 16 between the fork conveyors 2 opposite to each other.

In the above described board drying apparatus, the flow amount of the hot air circulating through the space 16 between the pair of fork conveyors is separately controllable with respect to the central portion and the side portions of the space 16.

That is, according to the present invention, as shown in FIG. 3, a number of rectifiers or flow regulators 17 for controlling the flow amount of the hot air are arranged in series in the horizontal direction at both the entrance portion and exit portion of the space 16 between the pair of fork conveyors 2, through which the hot air flows. Each of the rectifiers 17 is formed of, for example, a vertically elongated metal plate as shown in the figure. The central portions at the upper and lower end portions of the respective metal plates are respectively axially supported. The space 16 defined between the pair of fork conveyors 2, through which the hot air flows, is divided into a central passage portion C, a right side passage portion R, and a left side passage portion L. The front and rear rectifiers 17 corresponding to the right side passage portion R and the left side passage portion L are controlled to be in a half-opened state. The front and rear rectifiers 17 corresponding to the central passage portion C are controlled to be in a completely opened state. In this way, the flow amount of the hot air at the right and left passage portions R and L is set to be less than the flow amount thereof at the central portion, i.e., something like one divided by several numerical figures of the flow amount of the hot air at the central portion.

Figure 5:
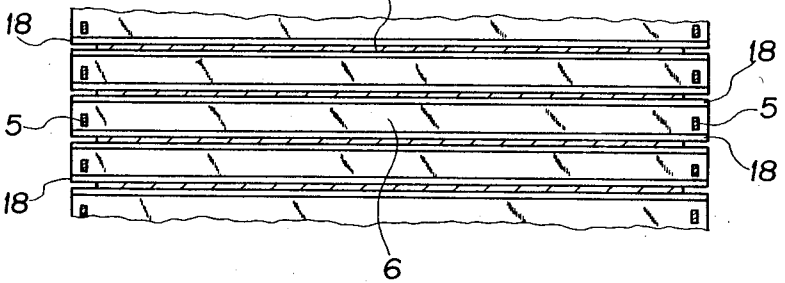
FIG. 5 is a side sectional view of the portion shown in FIG. 4.
Figure 4:
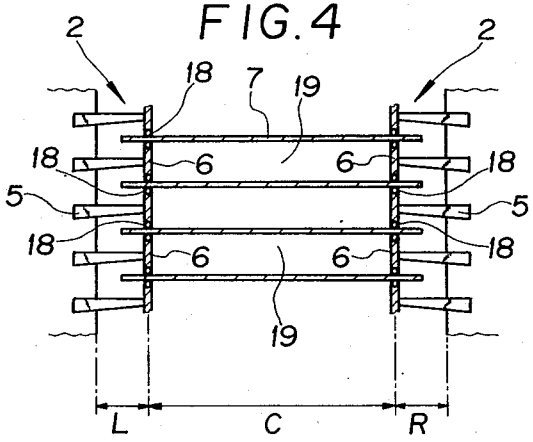
FIG. 4 is a partial front view showing the positional relation between a band-like board constituting the fork arm of a pair of fork conveyors and a board to be dried.

Furthermore, in the present invention, the strip shaped plate 6 constituting the fork arm 8 of the fork conveyor 2 is preferably formed such that the plate 6 has a comparatively large dimension in the vertical direction as shown in FIGS. 4 and 5. The upper and lower end faces of the strip shaped plate 6 are integrally connected with pipes 18 for pressing against the boards 7 to be dried. Thus, a closed space 19 having a tunnel shape is defined between the strip shaped plates 6 of the fork arms 8 of the pair of fork conveyors 2, and boards 7 to be dried and vertically held by the strip shaped plates. This tunnel shaped space 19 serves as central passage portion C. The front and rear open ends of the space 19 are disposed opposite to the rectifiers 17 at the central portion. Accordingly, the strip shaped plates 6, and the presser pipes 18 integrally connected thereto serve as partition walls for dividing the hot air circulating passage into the central passage portion C and right and left side passage portions L and R.

As described in the foregoing, according to the present invention, since a rectifier 17 for controlling the flow amount of the hot air is provided at each of the central portion and right and left side portions of the respective entrance sides and exit sides of the hot air circulating passage between the pair of fork conveyors 2, the flow amount of the hot air to the right and left passage portions L and R is controlled in such a manner as to be somewhat less than that to the central portions, the right and left marginal end portion of the boards to be dried are prevented from being over-dried, and the drying speed between the right and left marginal portions with respect to the elongated direction of the boards to be dried and the central portions can be made equal. Thus, a satisfactory product of excellent quality, free from dry cracking and wave shaped shrinkage at the marginal end portions can be treated at high drying efficiency.

Especially, the right and left fork arms 8 are preferrably provided at the tip end portions thereof with strip shaped plates 6 which are adapted to divide a space for the upper and lower boards to be dried into a central space portion and right and left side space portions. In the case this central space portion and right and left side space portions are arranged such as to be communicated with the central rectifiers and with the right and left portion rectifiers, respectively, the flow amount of the hot air at the central portion and the right and left portions of the boards to be dried can be comparatively accurately controlled. Thus, a desired dried board of high quality can be obtained.

Although the present invention has been described with reference to the preferred embodiment, many modifications and alternations may be made within the spirit of the present invention.

What is claimed is:

1. A board drying apparatus comprising:

a pair of spaced fork conveyor means for supporting boards to be dried, with the boards oriented horizontally and spaced vertically from each other, and for moving the thus supported boards downwardly;

means attached to said fork conveyor means for dividing the spaces between the boards into a central portion and opposite side portions;

heating means for producing hot air;

blower means for circulating hot air produced by said heating means in a horizontal direction between the boards through space between said pair of fork conveyor means, thereby drying the boards; and means, located at both entrance and exit ends of said space, with respect to the direction of flow of said hot air therethrough, for regulating the relative amounts of said hot air circulated through a central portion and opposite side portions of said space, and thereby for controlling the extent of drying of central portions and opposite side portions of the boards.

2. An apparatus as claimed in claim 1, wherein said regulating means comprise separate flow regulators located at said entrance and exit ends of said central portion and said opposite side portions of said space.

3. An apparatus as claimed in claim 2, wherein each said flow regulator comprises a vertically extending plate mounted for adjustment about a respective vertical axis.

4. An apparatus as claimed in claim 2, wherein each said fork conveyor means includes a plurality of fork arms each formed by a pair of horizontally spaced extension arms having free ends, said means for dividing the spaces between the boards comprising a horizontally extending strip-shaped plate fixed to said free ends, said strip-shaped plates extending along the entire longitudinal length of the boards to be dried and dividing said space into a central portion space and opposite side portion spaces, and respective said flow regulators are located at said entrance and exit ends of said central portion and opposite side portion spaces.

5. An apparatus as claimed in claim 4, wherein each said strip-shaped plate has at upper and lower edges thereof means for pressing against respective of the boards to be dried.

6. A board drying method comprising:

supporting boards to be dried with a pair of spaced fork conveyors, with said boards oriented horizontally and spaced vertically from each other, and moving the thus supported boards downwardly;

circulating hot air in a horizontal direction between said boards through space between said pair of fork conveyors, thereby drying said boards; and dividing said space into a central portion and opposite side portions, and regulating the relative amounts of said hot air circulated through said portions, such that the amount of said hot air circulated through said opposite side portions is less than the amount of said hot air circulated through said central portion, thereby controlling the relative extent of drying of central portions and opposite side portions of said boards.

7. A method as claimed in claim 6, wherein said regulating comprises controlling separate flow regulators positioned at entrance and exit ends, with respect to the direction of flow of said hot air through said space, of said central and opposite side portions of said space.

* * * * *